US008616377B2

(12) United States Patent
Maggio

(10) Patent No.: US 8,616,377 B2
(45) Date of Patent: Dec. 31, 2013

(54) DEVICE AND METHOD FOR SINGLE STREAM RECYCLING OF HAZARDOUS MATERIALS

(75) Inventor: Edward T. Maggio, San Diego, CA (US)

(73) Assignee: EcoPaq LLC, Austin, TX (US)

( * ) Notice: Subject to any disclaimer, the term of this patent is extended or adjusted under 35 U.S.C. 154(b) by 90 days.

(21) Appl. No.: 12/832,771

(22) Filed: Jul. 8, 2010

(65) Prior Publication Data

US 2011/0005977 A1 Jan. 13, 2011

Related U.S. Application Data

(60) Provisional application No. 61/224,339, filed on Jul. 9, 2009.

(51) Int. Cl.
*B07C 5/02* (2006.01)

(52) U.S. Cl.
USPC ..... 209/3.3; 209/2; 209/3; 209/522; 209/523; 209/524; 209/583; 209/702

(58) Field of Classification Search
USPC ..... 209/2, 3, 3.3, 576, 583, 702, 522, 523, 209/524; 206/223, 459.5; 134/10; 428/34.7
See application file for complete search history.

(56) References Cited

U.S. PATENT DOCUMENTS

| | | | | |
|---|---|---|---|---|
| 3,919,440 | A * | 11/1975 | Takahashi et al. | 215/12.2 |
| 4,053,666 | A * | 10/1977 | Taylor et al. | 428/34.7 |
| 4,055,441 | A * | 10/1977 | Taylor et al. | 134/10 |
| 5,037,379 | A * | 8/1991 | Clayman et al. | 600/37 |
| 5,318,713 | A * | 6/1994 | Binter | 510/224 |
| 5,611,803 | A * | 3/1997 | Heaven et al. | 606/114 |
| 7,278,568 | B2 * | 10/2007 | Kadaba | 235/375 |
| 7,291,370 | B2 * | 11/2007 | Gipson et al. | 428/36.1 |
| 2007/0267444 | A1 * | 11/2007 | de Buzzaccarini et al. | 222/179.5 |
| 2008/0179226 | A1 * | 7/2008 | Hunter et al. | 209/606 |
| 2009/0037293 | A1 * | 2/2009 | Unger et al. | 705/27 |
| 2011/0005977 | A1 * | 1/2011 | Maggio | 209/2 |

* cited by examiner

*Primary Examiner* — Terrell Matthews
(74) *Attorney, Agent, or Firm* — DLA Piper LLP (US)

(57) ABSTRACT

The present invention provides devices and methods for facilitating the single stream recycling of toxic substance-containing products. A toxin impermeable container designed to enclose the product containing toxic substances incorporates graphic markings or radiofrequency tags to facilitate automated or manual sorting from single stream recycling processes, identification of the toxic component, identification of the person or entity recycling the toxic to allow verification and documentation of compliance with government regulations or reimbursement of a recycling deposit that may be associated with the particular product.

22 Claims, 3 Drawing Sheets

Front

ZIPLOC®
Closures

Back

DEVICE AND METHOD FOR SINGLE STREAM RECYCLING OF HAZARDOUS MATERIALS

CROSS REFERENCE TO RELATED APPLICATION(S)

This application claims the benefit of priority under 35 U.S.C. §119(e) of U.S. Ser. No. 61/224,339, filed Jul. 9, 2009, the entire content of which is incorporated herein by reference.

BACKGROUND OF THE INVENTION

1. Field of the Invention

The present disclosure relates generally to the recycling of hazardous materials.

2. Background Information

As the human population continues to expand, the need for recycling of toxic substances becomes increasingly important as a means of preventing disease and preventing contamination of air, water and soil and in general preserving the quality of the environment for all living species. To encourage increasing compliance and cooperation with recycling efforts, many waste management organizations have resorted to "single stream" recycling processes. In single stream reprocessing, a variety of recyclable items are combined in a single recycling container. For example, these materials may include aluminum cans; glass bottles of clear, green, or brown color; plastic containers; newspaper; junk mail; discarded office documents; and the like. Often, toxic materials such as mercury containing light bulbs, nickel cadmium batteries, and lithium batteries are discarded along with the other recyclables even though it is generally regarded as inappropriate to do so.

When mixed single stream recyclable materials are brought to a processing center, the various types of materials are sorted and separated out so that they may be individually recovered for further processing. The mixed recyclable materials are typically placed on a conveyor belt, and sorting usually occurs by a combination of automated, semiautomated, and manual steps. For example, an early step may involve manual separation or "picking" of cardboard from the remainder of the stream. Light materials such as paper may be removed by means of an airstream that blows them off the conveyer into a designated bin. Items containing certain metals are removed through the use of magnets on an overhead conveyor belt that lifts them off the primary conveyor belt. Various types of plastic containers mixed into the recycling stream are typically identified visually and manually sorted into appropriate bins. Heavy materials such as glass bottles and broken glass typically proceed to a subsequent separation station. At present, there is no convenient way to easily identify, sort and separate certain relatively small and toxic disposables such as mercury containing compact fluorescent lamps, nickel cadmium batteries, lithium batteries, and the like either by manual visual inspection or electronic imaging equipment or imaging equipment.

SUMMARY OF THE INVENTION

The present invention provides methods for facilitating the single stream recycling of hazardous material as well as hazardous materials containers that facilitate such recycling by allowing for rapid identification, sorting and separation of the containers from a commingled waste stream.

Accordingly, in one aspect, the invention provides a single stream recycling container. The container includes a puncture resistant material, a resealable opening, a machine readable marking, and a marking observable by manual inspection. In various embodiments, the container is identifiable via automated detection of the machine readable marking or via visual detection of the marking observable by manual inspection, or by detection of both. In general, the container is impermeable to the hazardous material. In one embodiment, the container may further include sequestration agents for absorption of hazardous materials.

In various embodiments, the machine readable marking may be a one-dimensional, two-dimensional graphic tag, a three-dimensional tag, a fluorescent tag, an active transponder, a passive transponder, a magnetic tag, an inductive tag, or combination thereof. Depending on the type of machine readable marking, detection of the marking may be by radio-wave measurement, light-wave measurement, acoustic measurement, capacitive proximity sensing, inductive proximity sensing, active transponders, passive transponders, color determinative optical sensing, pattern determinative optical sensing, image sensing or any combination thereof.

Additionally, the marking observable by manual inspection is a visually observable marking including a one-dimensional, two-dimensional graphic, a three-dimensional tag, a fluorescent tag, a non-fluorescent colored tag, or a combination thereof. In exemplary embodiments, the container the machine readable marking and the marking observable by manual inspection are a two-dimensional graphic imprinted or deposited in a fluorescent dye, wherein the fluorescent dye is observable by the human eye.

In a related aspect, the invention provides a method of facilitating single stream recycling. The method includes depositing the hazardous material in a container of the present invention, introducing the container into a single stream recycling system comprising commingled waste, and separating the container from the commingled stream via sorting the container from the commingled waste by detection of the machine readable marking or the marking observable by manual inspection. In various embodiments the hazardous material may be environmental toxins, such as heavy metals or alkali metals. For example, the hazardous material may be a mercury containing light bulb, nickel-cadmium battery, or lithium battery.

In another aspect, the invention provides a kit include a container of the present invention including a warning label.

DETAILED DESCRIPTION OF THE INVENTION

Figure 1:
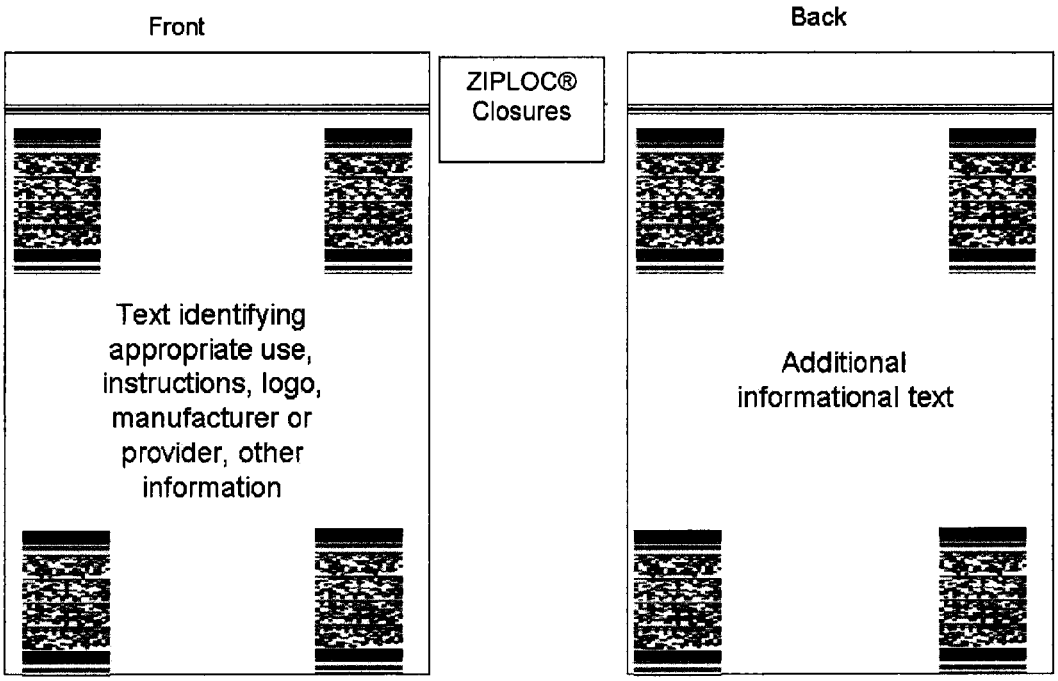
FIG. 1 shows an embodiment of the invention providing a puncture resistant single stream recycling enclosure with a resealable opening and multiple barcodes. The resealable opening employs a ZIPLOC® type closure.

Before the present devices and methods are described, it is to be understood that this invention is not limited to particular devices, methods, and experimental conditions described, as such devices, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

The present invention provides specifically designed recycling or shipping containers that incorporate graphic markings or radiofrequency tags, thus making it possible to quickly identify, both by manual visual inspection or machine identifiable markings, such as automated imaging, sorting, and separation of hazardous material containing waste, such as mercury containing compact fluorescent bulbs and other specifically designated toxin-containing products in the waste stream allowing the safe and responsible inclusion of products containing toxic substances into single stream recycling processes.

As used herein, hazardous material containing waste, typically includes materials that are known environmental toxins. Such toxins may include, but are not limited to alkali metals or heavy metals that have detrimental effects on ecosystems. Such metals may include Al, As, Cd, Co, Cr, Cu, Hg, Li, Mn, Ni, Pb, or Sn. Accordingly, hazardous materials may be mercury containing waste, such as mercury light bulbs, or batteries that contain nickel, cadmium or lithium Accordingly, in one aspect, the invention provides a single stream recycling container. The container includes a puncture resistant material, a resealable opening, a machine readable marking, and a marking observable by manual inspection.

In various aspects, a variety of materials are envisioned for use in fabricating the container component of the present invention so long as the resulting container is impermeable to the hazardous material intended to be contained. In an exemplary aspect, the material is puncture resistant so as to avoid rupture of the container by glass shards produced by a ruptured light bulb. For example, the material may include a puncture resistant plastic and/or polymer as described herein, such as MYLAR® or aluminized MYLAR®. Other puncture resistant plastics include TYVEK®, distributed by DuPont, which has found many uses in protection, security and safety in a wide variety of industries, including protective apparel, construction, envelopes, medical and industrial packaging, and graphics. Other plastics and/or polymeric materials as defined herein, including, DACRON® and KEVLAR® may be employed. Additionally, coated paper products, such as paperboard, cardboard, and the like may also be used as a puncture resistant material suitable for fabrication of the container device. In various aspects, a material, or combination of materials may be utilized. For example, the container may be fabricated from combinations of materials such as laminates. Additionally, the container may be fabricated such that the container is substantially rigid or is flexible depending on the desired application.

The container device of the present invention includes a sealable opening, such that the container is substantially impermeable to the hazardous material, such as mercury, when the opening is sealed. A variety of sealable openings are suitable for use with the container device. In one aspect, the opening may be mechanically sealed by closures, such as, but not limited to cable ties, twist ties, strings, elastic bands, and the like. Additionally, the opening may be sealed by employing an adhesive, such as an adhesive strip and/or contact adhesive to seal the opening. Further, the opening may be sealed by interlocking closures, such as, but not limited to zippers, similar to those used on resealable "zip lock" type bags. In various aspects, the opening may be sealed by one or a combination of closure features known in the art.

Additional detailed description of puncture resistant containers including specific materials manufacturing materials, methods of manufacture, mercury sequestering agents and container configurations are provided in U.S. Patent Application Publication No. 2009/0095133, filed Oct. 10, 2008 entitled "Methods, Compositions, and Devices for Safe Storage, Transport, Disposal and Recycling of Mercury Containing Light Bulbs" and herein incorporated in its entirety.

In various embodiments, the container is identifiable via automated detection of the machine readable marking or via visual detection of the marking observable by manual inspection, or by detection both. As used herein, a machine readable marking may be any marking detectable in an automated machine controlled fashion. A variety of such markings are known in the art. For example, the machine readable marking may be a one-dimensional graphic, two-dimensional graphic tag, a three-dimensional tag, a fluorescent tag, an active transponder, a passive transponder, a magnetic tag, an inductive tag, or combination thereof.

Depending on the machine readable marking, the marking may be detected by any suitable method, such as detection using radio-wave measurement, light-wave measurement, acoustic measurement, capacitive proximity sensing, inductive proximity sensing, active transponders, passive transponders, color determinative optical sensing, pattern determinative optical sensing, image sensing or any combination thereof.

In various embodiments, the container is also identifiable to the naked eye, (e.g., observable to the unaided eye of a human) via markings observable by manual inspection which may be visually observable markings, such as a one-dimensional, two-dimensional graphic, a three-dimensional tag, a fluorescent tag, a non-fluorescent colored tag, or a combination thereof.

Graphic markings may include linear (i.e., one-dimensional), or two-dimensional barcodes, a designated highly visible fluorescent or non-fluorescent color covering a substantial portion of the outer surface of the container, a specific graphic logo or geometric shape identified with recycling of the specific toxic material, which may be provided in either a fluorescent or non-fluorescent modality. In the case of graphic or visual markings, since the container can assume any orientation during the sorting and picking process, it is important that the visual markings, for example barcodes, colors, and logos, be displayed on all sides of the container. In addition, discrete visual elements such as barcodes and logos can be repeated multiple times on the container surfaces to allow for the possibility that a portion of the surface may be obscured by other recycled materials in the recycling stream.

Alternatively, active or passive transponders may be used. For example, an inexpensive, disposable radio frequency identification tag (RFID tag) of the type frequently used to mark merchandise may also be incorporated. RFID tags may be applied to or incorporated into a product for the purpose of identification and tracking using radio waves. Some tags can be read from several meters away and beyond the line of sight of the reader. Active RFID tags contain a battery and can transmit signals autonomously, and passive RFID tags have no battery and require an external source to provoke signal transmission. Either active or passive RFID tags may be used in the present invention, however the passive RFID tags are less costly and better suited for disposable single use applications.

Two dimensional barcodes have the ability to encode information in both the horizontal and vertical dimensions allowing for more information to be encoded. In addition to identifying the particular toxic hazard present within the recycling container, information useful in providing reimbursement of possible cash recycling deposits, identification of the originator of the toxic material being recycled, or information useful in demonstrating compliance with recycling regulations may also be included.

The container device of the present invention may be fabricated in a variety of dimensions and shapes sufficient to accommodate various hazardous materials. For example, the container may be suitably dimensioned to hold one or more mercury containing table lamp bulbs. Alternatively, the container may be dimensioned to include long cylindrical bulbs. A variety of standard bulb sizes are well known in the art. Similarly, the container may be dimensioned to hold one or more batteries of the same or different sizes.

Furthermore, to permit complete flexibility to address differences in the sequencing or nature of recycling processes (e.g., manual vs. automated identification and sorting) in different facilities, two or more of the graphic or electronic markings may be incorporated in a single recycling container. For example, an easily visible color coding may facilitate manual sorting, while a barcode or radiofrequency tag could facilitate automated sorting and removal at different stages during the processing.

Fluorescent dyes or images created using fluorescent dyes have specific properties that make them suitable for both manual visual identification as well as automated imaging identification. Specifically, fluorescent dyes have a very narrow excitation and emission wavelength band. Thus it is possible to irradiate an image or logo created using a fluorescent dye or fluorescent dye-containing ink having a specific excitation wavelength and detect the reemitted fluorescent light (fluorescence) by monitoring light emission at a second and higher emission wavelength. For example, the green dye fluorescein has an excitation wavelength of 495 nm and emission wavelength of 517 nm. Rhodamine B has an excitation wavelength of 540 nm and emission wavelength of 625 nm. Since these wavelengths are characteristic of each fluorophore, it is possible to identify objects marked with these fluorophores in a mixed waste stream allowing separation and sorting either by manual or automated picking. The use of fluorophores having different excitation and emission wavelengths makes it possible to separately identify and sort many different categories of toxic materials. Table I includes a list of fluorophores that may be used in the present invention.

TABLE I

| Fluorophores | | |
|---|---|---|
| Fluorophore | Excitation [nm] | Emission [nm] |
| 5-Hydroxytryptamine (HAT) | 370-415 | 520-540 |
| Acridine yellow | 470 | 550 |
| Acridine orange | 500 | 530 |
| Alexa Fluor 488 | 494 | 519 |

TABLE I-continued

| Fluorophores | | |
|---|---|---|
| Fluorophore | Excitation [nm] | Emission [nm] |
| Alexa Fluor 532 | 530 | 555 |
| Alexa Fluor 546 | 554 | 570 |
| BODIPY 500/510 | 508 | 515 |
| BODIPY 530/550 | 534 | 554 |
| Cascade Blue | 375 | 410 |
| Coumarin | 384 | 470 |
| CY2 | 489 | 506 |
| CY3 | 548 | 562 |
| CY5 | 650 | 670-700 |
| Dansyl | 340 | 520 |
| DAPI | 345 | 458 |
| DPH | 354 | 430 |
| Erythrosin | 529 | 554 |
| Ethidium Bromide | 510 | 595 |
| FITC | 494 | 518 |
| Fluorescein | 495 | 517 |
| FURA-2 | 340/380 | 500/530 |
| GFP | 395/489 | 509 |
| Hoechst 33258 | 365 | 480 |
| Hoechst 33342 | 355 | 465 |
| Laurdan | 364 | 497 |
| Lucifer yellow CH | 428 | 535 |
| Nile Red | 485 | 525 |
| Oregon Green 488 | 493 | 520 |
| Oregon Green 500 | 503 | 522 |
| Oregon Green 514 | 511 | 530 |
| Prodan | 361 | 498 |
| Pyrene | 341 | 376 |
| Rhodamine 110 | 496 | 520 |
| Rhodamine 123 | 505 | 534 |
| Rhodamine 6G | 525 | 555 |
| Rhodamine B | 540 | 625 |
| SITS | 336 | 438 |
| SNARF | 480 | 600/650 |
| Stilbene SITS, SITA | 365 | 460 |
| Texas Red | 589 | 615 |
| TOTO-1 | 514 | 533 |
| YOYO-1 | 491 | 509 |
| YOYO-3 | 612 | 631 |

In exemplary embodiments, the container includes a first and a second exposed surface, wherein the first and second exposed surface each comprise at least one machine readable marking and at least one marking observable by manual inspection.

The benefit of using the types of graphic or electronic markings described above is their flexibility so that a container that is designed for recycling fluorescent mercury containing compact fluorescent lamps, nickel cadmium batteries, or lithium batteries, can be easily distinguished to allow the separate manual or automated sorting of these widely different toxic materials.

A further benefit is that the graphic or electronic markings described above are suitable for virtually any size container, thus allowing containers of different size to be produced to accommodate the various shapes and sizes compact fluorescent lamps, as well as tubular or circular fluorescent lamps. Black lights, tanning lights, grow lights and germicidal lights are similar to fluorescent lights in that they contain mercury and should be recycled to prevent environmental contamination.

Since fluorescent bulbs and nickel-cadmium or lithium batteries are available in different shapes and sizes, it should be recognized that the dimensions and shapes of the single stream recycling containers may be varied to accommodate these different sizes or to accommodate the enclosure of multiple toxic items in a single container.

In addition, the embodiments of the present invention may be realized by attaching one or more labels containing at least one machine readable and one visually identifiable indicator making possible the rapid identification, sorting, and separation, by manual visual inspection or automated imaging, of containers otherwise designed for the containment of toxic materials so that they may be handled efficiently in single stream recycling processes.

In one embodiment, the container may further include sequestration agents for absorption of hazardous materials. For example, in one embodiment, the container includes a mercury sequestering agent, incorporated in the inner lining or permeable bag inside the container to absorb the mercury and facilitate future recover of the sequestered mercury. Mercury sequestering agents may include elemental sulfur, sulfur-impregnated activated carbon, a polymer comprising free thiol groups, activated charcoal, wood char, a zeolite, a molecular sieve, or a combination thereof.

Additional detailed description of mercury sequestering agents and container configurations are provided in U.S. Patent Application Publication No. 2009/0095133, filed Oct. 10, 2008 entitled "Methods, Compositions, and Devices for Safe Storage, Transport, Disposal and Recycling of Mercury Containing Light Bulbs" and herein incorporated in its entirety.

In describing the embodiments of the invention, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

In a related aspect, the invention provides a method of facilitating single stream recycling. The method includes depositing the hazardous material in a container of the present invention, introducing the container into a single stream recycling system comprising commingled waste, and separating the container from the commingled stream via sorting the container from the commingled waste by detection of the machine readable marking or the marking observable by manual inspection. In various embodiments, separation of the hazardous materials container may be separated via sorting the container from the commingled waste by detection of the machine readable marking and the marking observable by manual inspection. The method may further include reclaiming the hazardous material from the container by known methods. For example, mercury may be reclaimed via pyrolysis of a mercury sequestering agent.

In another aspect, the invention provides a kit including a container of the present invention including a warning label. The container may include additional labeling including instructions for proper handling and disposal of discarded mercury containing bulbs.

EXAMPLE 1

Puncture Resistant Containers Having Identifiable Markers

This example illustrates three embodiments of the presently disclosed invention.

FIG. 1 shows an embodiment of the invention providing a puncture resistant single stream recycling enclosure with a resealable opening and multiple barcodes. The resealable opening employs a ZIPLOC® type closure. Different background colors may be selected which indicate different types of toxic materials. Size may vary to accommodate one or more compact fluorescent bulbs of different size.

Figure 2:
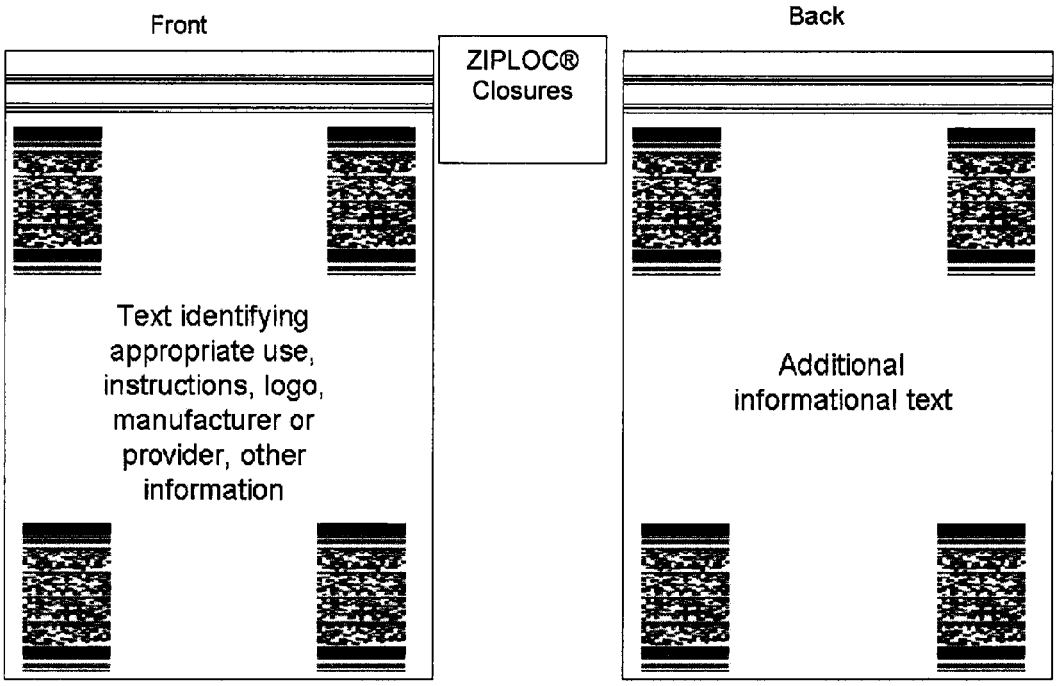
FIG. 2 shows an embodiment of the invention shown in FIG. 1 where the resealable opening employs a double ZIPLOC® type closure.

FIG. 2 shows an embodiment of the invention shown in FIG. 1 where the resealable opening employs a double ZIPLOC® type closure.

Figure 3:
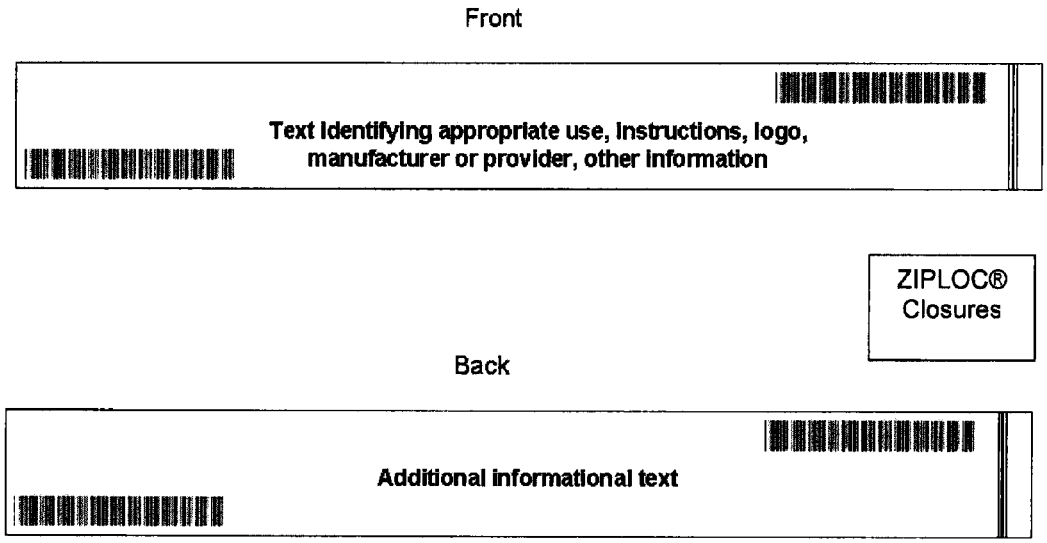
FIG. 3 shows an embodiment of the invention providing an elongated puncture resistant single stream recycling enclosure having a ZIPLOC® type closure, usable with, for example, tubular bulbs.

FIG. 3 shows an embodiment of the invention providing an elongated puncture resistant single stream recycling enclosure having a ZIPLOC® type closure, usable with, for example, tubular bulbs. The enclosure length may be varied to accommodate bulbs of different lengths and widths may be varied to accommodate the enclosure of multiple bulbs in a single container.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A single stream recycling container comprising:

a) a puncture resistant material lining the container;

b) a resealable opening;

c) a machine readable marking;

d) a marking observable by manual inspection; and e) a mercury sequestering agent disposed within the puncture resistant material when the resealable opening is in a closed configuration and adapted to sequester mercury from within the puncture resistant material;

wherein the container is identifiable via automated detection of the machine readable marking or via visual detection of the marking observable by manual inspection, and wherein the container is impermeable to toxins upon sealing of the opening.

2. The container of claim 1, wherein the machine readable marking is selected from the group consisting of: a one-dimensional graphic tag, a two-dimensional graphic tag, a three-dimensional tag, a fluorescent tag, an active transponder, a passive transponder, a magnetic tag, an inductive tag, or combination thereof.

3. The container of claim 2, wherein the one-dimensional or two-dimensional graphic tag is a barcode, logo, or graphic icon.

4. The container of claim 2, wherein the machine readable marking is a one-dimensional or two-dimensional graphic tag deposited or imprinted with a fluorescent dye.

5. The container of claim 2, wherein the passive transponder is a radiofrequency identification tag.

6. The container of claim 2, wherein the fluorescent tag is a fluorescent dye having a known excitation and emission wavelength.

7. The container of claim 1, wherein the machine readable marking is detectable using radio-wave measurement, light-wave measurement, acoustic measurement, capacitive proximity sensing, inductive proximity sensing, active transponders, passive transponders, color determinative optical sensing, pattern determinative optical sensing, image sensing or any combination thereof.

8. The container of claim 1, wherein the marking observable by manual inspection is a visually observable marking selected from the group consisting of: a one-dimensional graphic, a two-dimensional graphic, a three-dimensional tag, a fluorescent tag, a non-fluorescent colored tag, or a combination thereof.

9. The container of claim 8, wherein the marking observable by manual inspection is a fluorescent tag, a non-fluorescent colored tag, a graphic logo or geometric shape.

10. The container of claim 8, wherein the machine readable marking and the marking observable by manual inspection are a one-dimensional or two-dimensional graphic imprinted or deposited in a fluorescent dye, wherein the fluorescent dye is observable by the human eye.

11. The container of claim 1, wherein the container comprises a first and a second exposed surface, wherein the first and second exposed surface each comprise at least one machine readable marking and at least one marking observable by manual inspection.

12. The container of claim 1, wherein the mercury sequestering agent is selected from the group consisting of elemental sulfur, sulfur-impregnated activated carbon, a polymer comprising free thiol groups, activated charcoal, wood char, a zeolite, a molecular sieve, or a combination thereof.

13. A method of facilitating single stream recycling comprising:

a) depositing the hazardous material in the container of claim 1;

b) introducing the container of (a) into a single stream recycling system comprising commingled waste; and c) separating the container of (b) via sorting the container from the commingled waste by detection of the machine readable marking or the marking observable by manual inspection, thereby facilitating single stream recycling.

14. The method of claim 13, wherein separating the container of (b) is performed via sorting the container from the commingled waste by detection of the machine readable marking and the marking observable by manual inspection.

15. The method of claim 13, wherein the method further comprising reclaiming the hazardous material.

16. The method of claim 13, wherein the hazardous material is an environmental toxin.

17. The method of claim 16, wherein the environmental toxin is a heavy metal or alkali metal.

18. The method of claim 17, wherein the metal is selected from the group consisting of Al, As, Cd, Co, Cr, Cu, Hg, Li, Mn, Ni, Pb, or Sn.

19. The method of claim 16, wherein the hazardous material is an alkali or heavy metal containing battery or light bulb.

20. A kit comprising the container of claim 1, and further comprising a warning label.

21. The kit of claim 20, wherein the warning label comprises graphics warning of hazards from mercury and handling instructions.

22. The container of claim 5, wherein the passive radiofrequency transponder is configured to identify the toxic hazard.

* * * * *